US006086411A

United States Patent [19]

Shinozaki

[11] Patent Number: 6,086,411

[45] Date of Patent: Jul. 11, 2000

[54] CONNECTOR

[75] Inventor: Tetsuya Shinozaki, Yokkaichi, Japan

[73] Assignee: Sumitomo Wiring Systems, Ltd., Japan

[21] Appl. No.: 09/248,261

[22] Filed: Feb. 11, 1999

[30] Foreign Application Priority Data

Feb. 16, 1998 [JP] Japan ..... 10-033352

[51] Int. Cl.[7] ..... H01R 3/00

[52] U.S. Cl. ..... 439/489; 439/188; 439/521; 439/350

[58] Field of Search ..... 439/489, 488, 439/350, 351, 519, 521, 188, 352, 587, 588, 589, 595, 598, 357, 358

[56] References Cited

U.S. PATENT DOCUMENTS 5,145,356 9/1992 Minnis .
5,562,486 10/1996 Saijo et al. .
5,613,872 3/1997 Fukuda et al. .
5,651,693 7/1997 Fukuda et al. .
5,863,216 12/1999 Tsuji et al. ..... 439/489
5,997,344 12/1999 Shinozaki ..... 439/489

*Primary Examiner*—Gary F. Paumen
*Assistant Examiner*—Ross Gushi
*Attorney, Agent, or Firm*—Banner & Witcoff, Ltd.

[57] ABSTRACT

An electrical connector has a sealing face 30 provided along the entire circumference of a side edge and upper face of a foot member 25 and along outer side faces and an outer base face of a terminal housing chamber 23. An operating member 26B and short-circuiting terminal 24 are sealed by a boot 31, an opening edge 31A of the boot 31 fitting tightly with a continuous sealing circumference face 30, thereby preventing the entry of water or dirt. The arrangement ensures that the locking arm 26 can be operated without risk of breaking the seal.

15 Claims, 4 Drawing Sheets

CONNECTOR

TECHNICAL FIELD

The present invention relates to an electrical connector.

BACKGROUND OF THE INVENTION

A connector capable of detecting whether male and female housings are in a correctly fitted state is known. In one example, the connector has a housing with a flexible locking arm, and a short-circuiting terminal which is pressed and changes position when the locking arm is inclined. Another housing has a locking protrusion and a detecting terminal. When the two housings are in the process of being fitted together, that is, when they are in a half-fitted state, the anterior end of the locking arm makes contact with the locking protrusion and inclines, pushing the short-circuiting terminal and causing it to move. As a result, the detecting terminal and the short-circuiting terminal are no longer in contact. When the two housings attain a correct fitting position, the contact with the locking protrusion ceases, the locking arm returns resiliently to its original position, and a locking hole in the locking arm fits with the locking protrusion, thereby locking the two housings. As the locking arm returns resiliently to its original position, the short-circuiting terminal also returns to its original position and makes contact with the detecting terminal. That is, whether the fitted state is correct or not is determined according to whether or not an electric connection exists between the detecting terminal and the short-circuiting terminal.

The detecting terminal is in electrical contact with the short-circuiting terminal and, as a result, water, dirt, and the like must be prevented from making contact with them, as these could result in current leakage or poor contact. However, since the locking arm needs to be operated by hand, the external face of the housing has to be exposed. Consequently, the short-circuiting terminal which is pressed and thereby moved by the locking arm is also open to the exterior. As a result, there is the problem that the connector cannot be used in environments where water or dirt tend to enter from the exposed portion.

The present invention has been developed after taking the above problem into consideration, and aims to present a connector provided with a fitting detecting function which is resistant to water and dirt.

SUMMARY OF THE INVENTION

According to the invention there is provided an electrical connector comprising a housing, a locking arm on the housing, movable between latched and unlatched conditions, and a short-circuiting terminal responsive to movement of said locking arm to indicate said latched and unlatched conditions, the locking arm having an operating member and being mounted on said housing via a foot, characterised in that a resilient sealing boot is provided for the operating member and the short-circuiting terminal, the mouth of the boot defining a seal adapted for tight engagement with a sealing circumference of said housing, and said sealing circumference extending along opposite sides of said foot. Such a connector has the advantage that the boot encloses the operating member and short-circuiting terminal, and the sealing circumference extends along the foot, which is substantially stationary relative to the movable locking arm. As a result the boot is less likely to be dislodged as the operating member is pressed through the boot wall, and the locking arm can make direct contact with the short-circuiting terminal.

A clamp ring of e.g. metal may be provided to secure the boot on the connector, and the clamp ring ring may itself be engaged by latch arms of the housing. Preferably the housing, foot, locking arm and latch arms are moulded in plastic as one part.

BRIEF DESCRIPTION OF DRAWINGS

Other features of the invention will be apparent from the following description of a preferred embodiment shown by way of example only in the accompanying drawings in which.

DESCRIPTION OF PREFERRED EMBODIMENT

An embodiment of the present invention is explained below with the aid of FIGS. 1 to 4.

Figure 1:
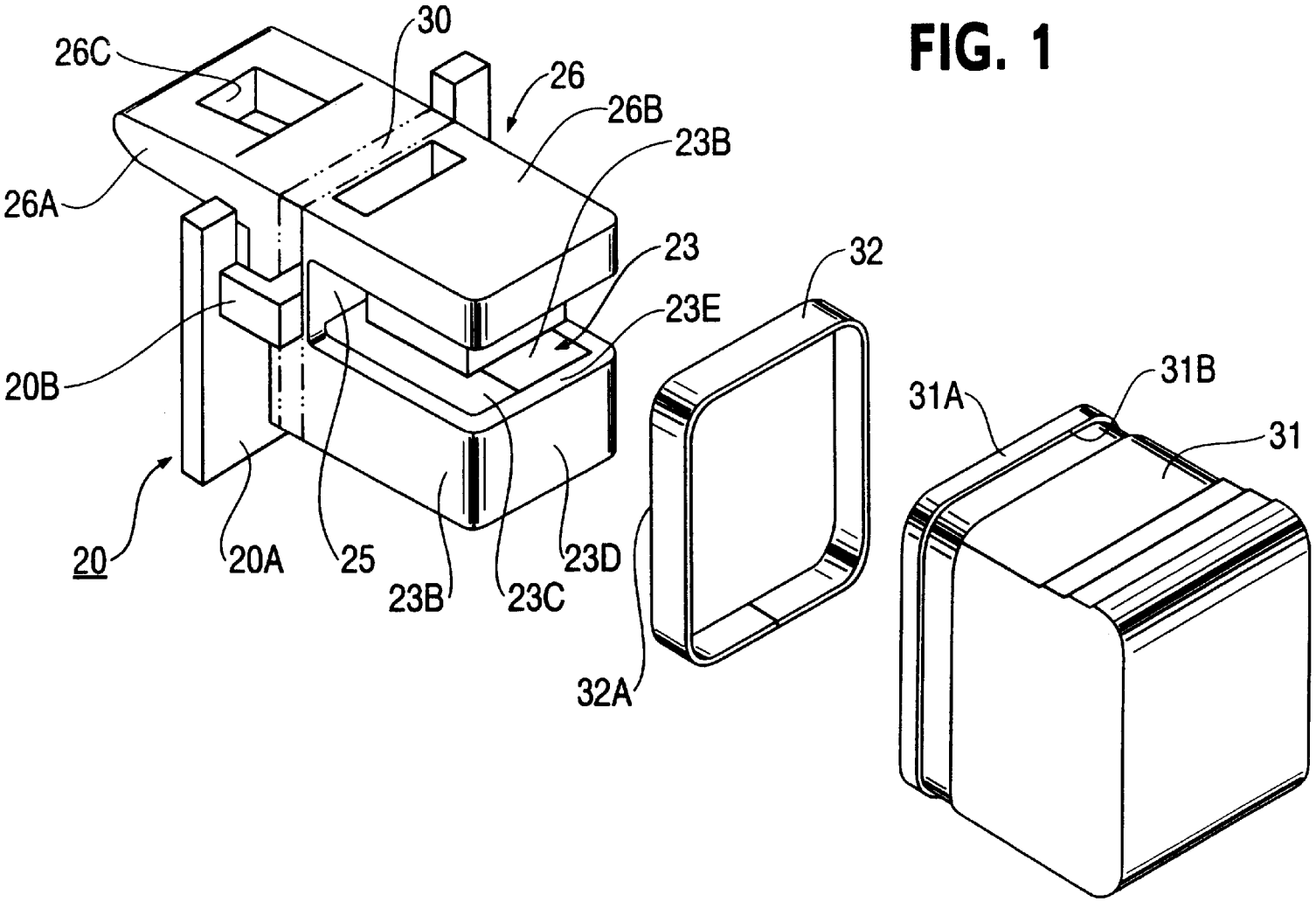
FIG. 1 is a diagonal exploded view of an embodiment of the invention.
Figure 2:
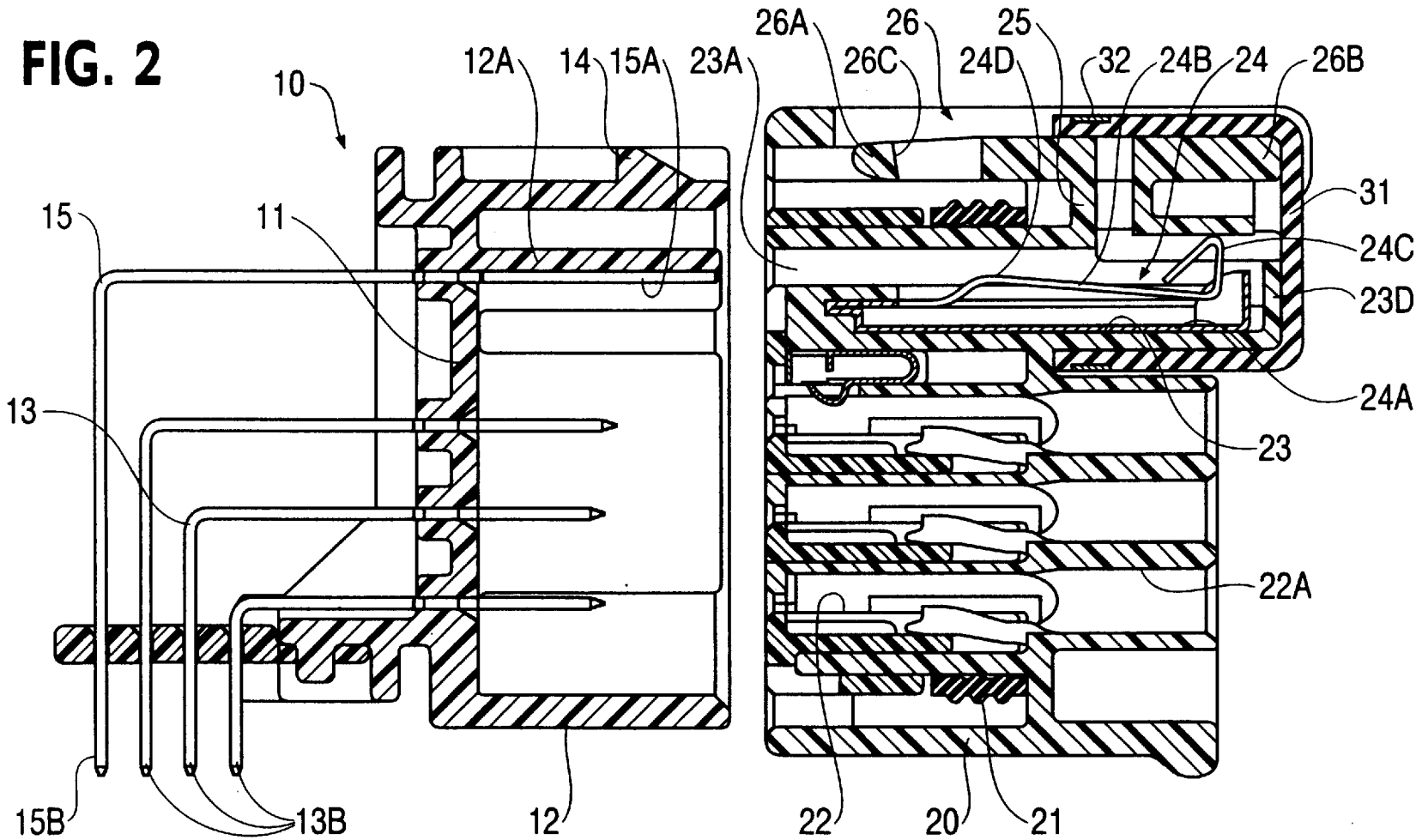
FIG. 2 is a cross-sectional view of the embodiment separated from a corresponding housing.
Figure 3:
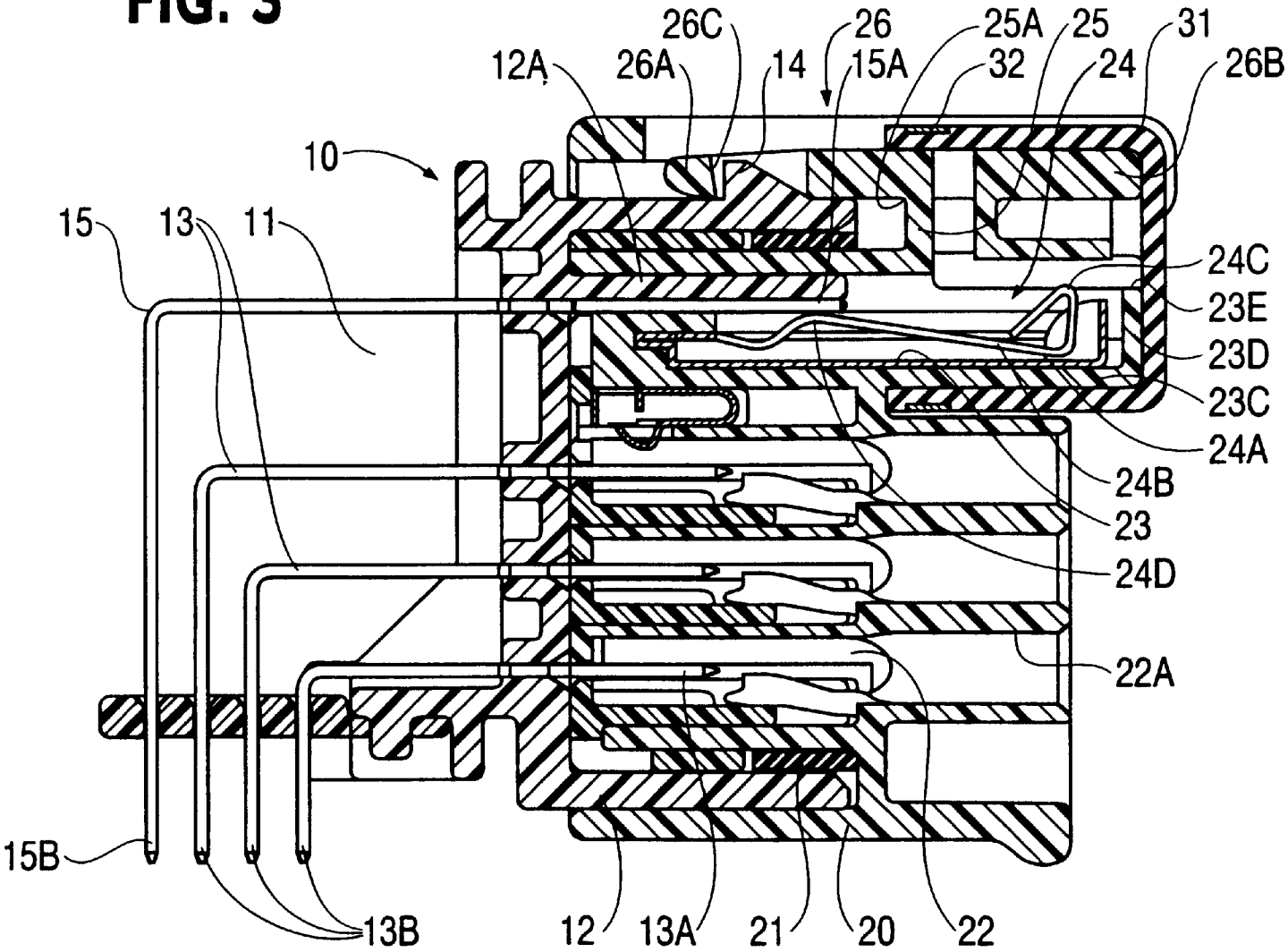
FIG. 3 is a cross-sectional view of the embodiment fitted with the corresponding housing.
Figure 4:
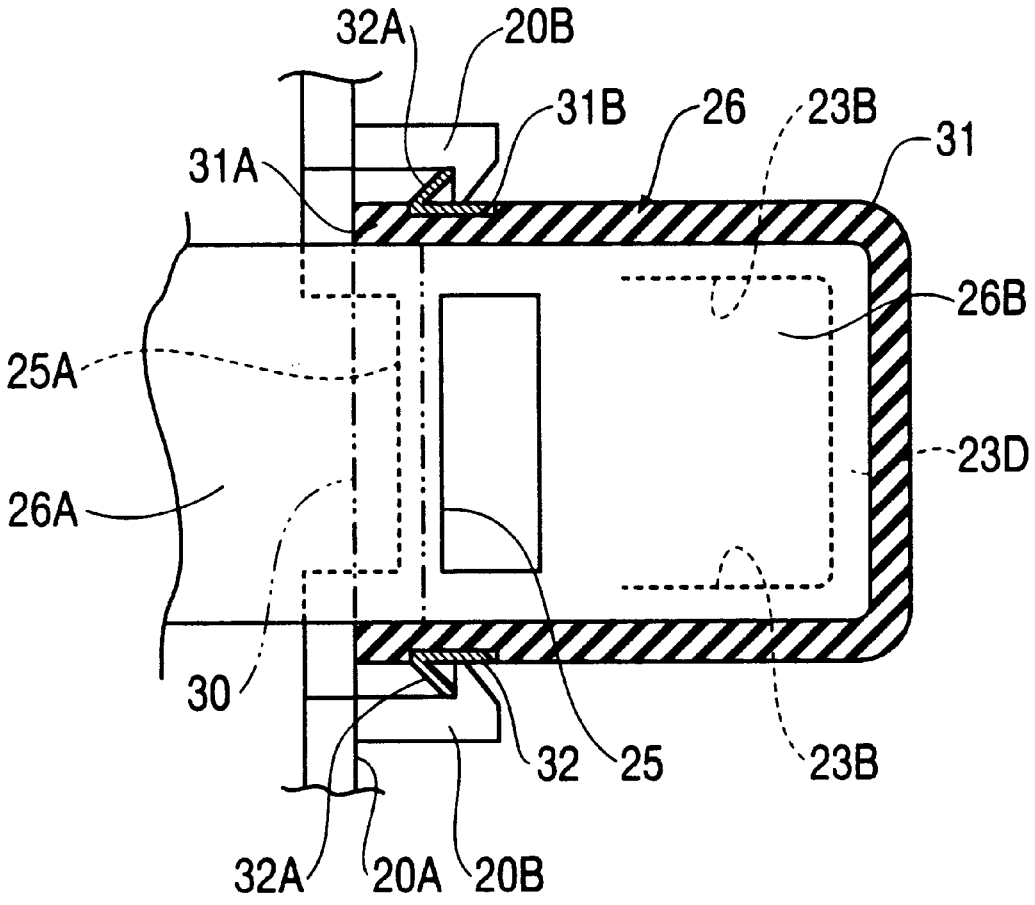
FIG. 4 is a partially cut-away plan view of a resilient sealing cover in an attached state.

A male housing 10 is provided on the left side in FIG. 2 and FIG. 3, and a female housing 20 is shown on the right. The male housing 10 is made from plastic and has a hood member 12, this hood member 12 protruding anteriorly from a supporting wall 11 and fitting with the female housing 20. L-shaped male terminal fittings 13 pass through the supporting wall 11. Joining members 13A of the male terminal fittings 13 face the hood member 12 and, on the other end of the male terminal fittings 13, attachment members 13B face downwards and are attached to a circuit board (not shown). If the male housing 10 is attached, for example, to a waterproof computer unit (not shown) of a motor vehicle, the hood member 12 will protrude to the exterior. A locking protrusion 14 is formed on the upper face of the hood member 12, this locking protrusion 14 being engaged by a locking arm 26 when the female housing 20 is fitted to the male housing 10.

A pair of L-shaped detecting terminals 15 (one hidden behind the other in FIGS. 2 and 3) pass through the supporting wall 11, detecting members 15A thereof extending along a ceiling face 12A of the hood member 12 in an anterior direction. On the other ends of the detecting terminals 15, attachment members 15B are bent downwards at the posterior side of the supporting wall 11 so as to be connected to the circuit board.

The female housing 20 is made from plastic, sealing members 21 made from rubber being fitted to the external circumference thereof. When these sealing members 21 are fitted to the hood member 12, the fitted portion is waterproofed by the sealing members 21. Female terminal fittings (not shown) are inserted from the posterior (the right side) into cavities 22 formed within the female housing 20. Insertion holes 22A of these cavities 22 are waterproofed by rubber stoppers (not shown) which are attached to the female terminal fittings.

A terminal housing chamber 23 is formed in the upper portion of the female housing 20, the anterior face of this terminal housing chamber 23 having a receiving hole 23A for the detecting terminals 15. A short-circuiting terminal 24 is housed within the terminal housing chamber 23, a pair of resiliently bendable members 24B extending from the anterior end of a base plate 24A and being folded over backwards. Each of the extended ends (the posterior ends) of the short-circuiting terminal 24 is bent into a triangular shape to form a pressed member 24C and, slightly to the anterior of the pressed members 24C, are hump shaped contacted members 24D which make contact with the detecting terminals 15.

A portion of the terminal housing chamber 23 corresponding to the pressed members 24C is open in the direction of the upper face of the female housing 20. Side walls 23B and a base face 23C constituting this portion protrude in a posterior direction from an upper posterior end wall 20A, this upper posterior end wall 20A extending slightly into the anterior of the female housing 20. Moreover, an upper edge of a posterior face wall 23D which links the posterior ends of the side walls 23B forms an excessive bending prevention member 23E for preventing the locking arm 26 from exceeding its limit of resilience when it bends.

An upright foot member 25 is formed at the upper face of the female housing 20. It extends along the upper posterior end wall 20A and has the same width as the terminal housing chamber 23. A cut-away section 25A, the anterior face of which is open, is formed in a concave shape on this foot member 25. It has the width of the outer side face of the foot member 25, thereby allowing the foot member 25 to bend easily in an anterior-posterior direction.

Further, the locking arm 26 is formed in a unified manner on the upper edge of the foot member 25, the locking arm 26 having a stopping member 26A extending from an anterior direction and having the same width as the foot member 25, and an operating member 26B extending from a posterior direction. A locking hole 26C is formed on the stopping member 26A, this locking hole 26C being capable of fitting together with the locking protrusion 14 of the male housing 10. The operating member 26B is located over the pressed members 24C of the short-circuiting terminal 24. The locking arm 26 moves in a see-saw fashion, causing the foot member 25 to bend slightly and the operating member 26B to move downwards.

While the male housing 10 and the female housing 20 are being fitted together, the tip of the locking arm 26 makes contact with the locking protrusion 14 and, as a result, the operating member 26B moves downwards, pressing down the pressed members 24C together with the contact members 24D, the short-circuiting terminal 24 thereby no longer making contact with the detecting terminals 15. When the male housing 10 and the female housing 20 have reached the correct fitted state, the tip of the locking arm 26 is released from the locking protrusion 14, the locking arm 26 returns resiliently to its original position, and the locking protrusion 14 fits with the locking hole 26C, thereby locking the male housing 10 and the female housing 20 in a latched state. Further, as the locking arm 26 returns resiliently to its original position, the operating member 26B ceases to press down on the pressed members 24C. As a result, the short-circuiting terminal 24 returns resiliently to its original position, and the contact members 24D contact with the detecting terminals 15, thereby causing the detecting terminals 15 to short-circuit. That is, the fitted state of the male housing 10 and the female housing 20 can be detected according to whether the detecting terminals 15 are short-circuited or not.

When the male housing 10 and the female housing 20 are to be separated, the operating member 26B is pressed downwards, separating the locking hole 26C from the locking protrusion 14 and releasing the latch. The male housing 10 and the female housing 20 can be pulled apart from this state.

Next, the means for preventing the entry of water or dirt into the terminal housing chamber 23 is explained.

The outer side face of the foot member 25 joins above and below with the base end outer faces of the side walls 23B to form a single face. A sealing circumference face 30 extends along the upper posterior end wall 20A by passing over the outer side face of the foot member 25, the outer face of the side walls 23B, the upper end face of the foot member 25, and the outer face of the base face 23C of the terminal housing chamber 23. Moreover, the operating member 26B of the locking arm 26 and the posterior end portion of the terminal chamber 23 protrudes towards the posterior with respect to this sealing circumference face 30, these protruding portions being covered from the posterior by a resilient sealing cover 31 which is box-shaped and is open on its anterior face. The resilient sealing cover 31 is made from soft rubber and can, if required, be made heat- or corrosion-resistant. An opening edge 31A of the anterior face of the resilient sealing cover 31 is fitted, in a somewhat resiliently opened state, to the outside of the sealing circumference face 30. As a result, the resilient force returning the resilient sealing cover 31 to its original state causes the opening edge 31A to adhere closely to the sealing circumference face 30.

A shallow attachment groove 31B is formed along the outer circumference of the opening edge 31A of the resilient sealing cover 31, a metal clamp ring 32 being fitted to the exterior thereof. The size of this clamp ring 32 is greater than that of the sealing circumference face 30, this difference in size being slightly less than the thickness of the resilient sealing cover 31. As a result, the opening edge 31A of the resilient sealing cover 31 is clamped from the inside and the outside between the clamp ring 32 and the sealing circumference face 30, crushing the opening edge 31A and causing it to change shape. By this means, a tight seal is obtained along the entire circumference of the sealing circumference face 30, and the entry to water or dirt into the terminal housing chamber 23 of the operating member 26B can be reliably prevented.

Stopping members 32A are formed on the right and left side edges of the clamp ring 32, these stopping members 32A protruding diagonally outwards in a posterior direction. Hook-shaped receiving protrusions 20B are formed on the upper posterior end wall 20A. The stopping members 32A fit with these receiving protrusions 20B, thereby regulating the removal in a posterior direction of the clamp ring 32 and the resilient sealing cover 31.

As far as the order of attachment of the clamp ring 32 and the resilient sealing cover 31 is concerned, the resilient sealing cover can be attached to the female housing 20 with the clamp ring 32 already fitted to the resilient sealing cover 31, or the resilient sealing cover 31 alone can first be attached to the female housing 20, the clamp ring 32 being fitted to the resilient sealing cover 31 thereafter. In order to attach the clamp ring 32, the stopping members 32A bend inwards resiliently and pass over the receiving protrusions 20B, after which the stopping members 32A resiliently return to their original shape and fit with the receiving protrusions 20B.

In the embodiment described above, the operating member 26B of the locking arm 26 and the posterior end portion of the terminal housing chamber 23 are covered by the resilient sealing cover 31. In addition, the opening edge 31A of the resilient sealing cover 31 is made to fit tightly with the sealing circumference face 30, thereby reliably preventing the entry of water or dirt into the terminal housing chamber 23. Furthermore, the resilient sealing cover 31 is made from rubber which bends easily and, consequently, there is no hindrance to the pressing operation of the operating member 26B when the lock is released.

The clamp ring 32 is used to clamp the opening edge 31A of the resilient sealing cover so as to crush it resiliently between the clamp ring 32 and the sealing circumference face 30 along its inner and outer circumferences. As a result, compared to the case in which the resilient sealing cover 31 is attached tightly to the sealing circumference face 30 only by its force of contraction, the resilient sealing cover 31 has greater holding power. In addition, the removal of the resilient sealing cover 31 is also prevented in a highly effective manner.

Further, when the locking arm 26 is moved, the upper face position of the sealing circumference face 30 inclines slightly. However, the opening edge 31A of the resilient sealing cover 31 also bends resiliently to match this inclining and consequently there is no damage to the seal.

In order to make the locking arm 26 move easily, the locking arm 26 is supported by the foot member 25 which protrudes from the upper face of the female housing 20. In spite of this, the shape of the resilient sealing cover 31 remains simple since the sealing circumference face 30 is arranged to extend along the outer side face and the upper end face of the foot member 25.

The present invention is not limited to the embodiments described above with the aid of figures. For example, the possibilities described below also lie within the technical range of the present invention. In addition, the present invention may be embodied in various other ways without deviating from the scope thereof.

(1) In the present embodiment, the clamp ring is made from metal. However, according to the present invention, hard plastic or some other material which is not readily deformed may equally well be used.

(2) In the present embodiment, the inner circumference of the opening edge of the resilient sealing cover forms a flat face. However, a lip member may equally well be formed to face outwards and function as a seal. The inner circumference of the opening edge of the resilient sealing cover may also be formed in a convex and concave shape, the sealing circumference face also having a corresponding convex and concave shape, thus allowing the resilient sealing cover to be retained.

(3) In the present embodiment, the clamp ring resiliently clamps the opening edge of the resilient sealing cover between the clamp ring and the sealing circumference face. However, according to the present invention, the clamp ring can be omitted, and the opening inner edge of the resilient sealing cover may be attached tightly to the sealing circumference face with adhesive.

(4) In the present embodiment, the clamp ring forms a separate component from the resilient sealing cover. However, according to the present invention, a clamp ring made from hard plastic can be formed in a unified manner with the resilient sealing cover by two-component moulding.

What is claimed is:

1. An electrical connector comprising a housing, a locking arm on the housing, movable between latched and unlatched conditions, and a short-circuiting terminal in the housing and responsive to movement of said locking arm to indicate said latched and unlatched conditions, the locking arm having an operating member and being mounted on said housing via a foot, wherein a resilient sealing boot is provided for said operating member and said short-circuiting terminal, the mouth of the boot defining a seal adapted for tight engagement with a sealing circumference of said housing, and said sealing circumference extending along opposite sides of said foot.

2. A connector according to claim 1 wherein said locking arm extends on either side of said foot, one side of said locking arm comprising said operating member, and the other side of said locking arm comprising a latch member, wherein said sealing circumference extends from a point on said housing along one side of said foot, over said locking arm, along the other side of said foot and around a portion of said housing to said point.

3. A connector according to claim 1 wherein said locking arm extends on either side of said foot and is movable in a see-saw fashion.

4. A connector according to claim 1 and further including a clamp ring adjacent to mouth of said boot on the outside, said clamp ring being adapted to urge said seal and sealing circumference into tight engagement.

5. A connector according to claim 4 wherein said boot includes a circumferentially extending channel adapted to receive said clamp ring.

6. A connector according to claim 4 wherein said housing further includes latch arms for engagement with said clamp ring and adapted to retain said clamp ring in a predetermined position.

7. A connector according to claim 6 wherein said latch arms comprise resilient hook members, and said clamp ring include protrusions for engagement with said hook members.

8. A connector according to claim 6 wherein said boot includes a circumferentially extending channel adapted to receive said clamp ring.

9. A connector according to claim 1 wherein said seal is defined on the inside of said boot.

10. A connector according to claim 9 and further including a clamp ring adjacent to mouth of said boot on the outside, said clamp ring being adapted to urge said seal and sealing circumference into tight engagement.

11. A connector according to claim 10 wherein said housing further includes latch arms for engagement with said clamp ring and adapted to retain said clamp ring in a predetermined position.

12. A connector according to claim 6 wherein said latch arms comprise resilient hook members, and said clamp ring include protrusions for engagement with said hook members.

13. A connector according to claim 12 wherein said boot includes a circumferentially extending channel adapted to receive said clamp ring.

14. A connector according to claim 1 wherein said housing includes a chamber for said short-circuiting terminal, said sealing circumference extending around said chamber.

15. A connector according to claim 14 wherein said sealing chamber is open on the side facing said locking arm whereby said operating member can contact said short-circuiting terminal directly.

* * * * *